US007012052B1

(12) United States Patent
Kluesener et al.

(10) Patent No.: US 7,012,052 B1
(45) Date of Patent: Mar. 14, 2006

(54) AUTOMATIC DISHWASHING COMPOSITIONS COMPRISING SELECTED NONIONIC SURFACTANTS

(75) Inventors: Bernard William Kluesener, Harrison, OH (US); William Michael Scheper, Lawrenceburg, IN (US); Mark Robert Sivik, Ft. Mitchell, KY (US); Glenn Thomas Jordan, IV, Indian Springs, OH (US); Donna Jean Haeggberg, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/913,870

(22) PCT Filed: Feb. 10, 2000

(86) PCT No.: PCT/US00/03455

§ 371 (c)(1),
(2), (4) Date: Aug. 20, 2001

(87) PCT Pub. No.: WO00/50551

PCT Pub. Date: Aug. 31, 2000

Related U.S. Application Data

(60) Provisional application No. 60/121,034, filed on Feb. 22, 1999.

(51) Int. Cl.

| | |
|---|---|
| ***C11D 1/72*** | (2006.01) |
| ***C11D 1/722*** | (2006.01) |
| ***C11D 3/37*** | (2006.01) |
| ***C11D 3/395*** | (2006.01) |
| ***B08B 3/04*** | (2006.01) |

(52) U.S. Cl. ..... 510/221; 510/224; 510/231; 510/413; 510/421; 510/475; 510/524; 134/25.2; 134/39; 134/42

(58) Field of Classification Search ..... 510/221, 510/224, 231, 413, 421, 475, 524; 134/25.2, 134/39, 42
See application file for complete search history.

(56) References Cited

U.S. PATENT DOCUMENTS

| | | | | |
|---|---|---|---|---|
| 4,272,394 | A | | 6/1981 | Kaneko |
| 5,294,365 | A | | 3/1994 | Welch et al. |
| 5,766,371 | A | | 6/1998 | Bunch et al. |
| 5,912,218 | A | * | 6/1999 | Chatterjee et al. ..... 510/220 |
| 5,967,157 | A | * | 10/1999 | Chatterjee et al. ..... 134/25.2 |

FOREIGN PATENT DOCUMENTS

| | | | |
|---|---|---|---|
| EP | 0 124 815 A2 | | 4/1984 |
| EP | 0 254 208 A2 | | 7/1987 |
| EP | 0 343 504 A1 | | 5/1989 |
| GB | 2 158 080 A | | 11/1985 |
| WO | WO 93/04153 | | 3/1993 |
| WO | WO 95/34633 | * | 12/1995 |
| WO | WO 98/11186 | * | 3/1998 |
| WO | WO 99/06466 | * | 2/1999 |

* cited by examiner

*Primary Examiner*—Brian P. Mruk
(74) *Attorney, Agent, or Firm*—Laura R. Grunzinger; Kim W. Zerby; Steven W. Miller

(57) ABSTRACT

Automatic dishwashing detergent compositions comprising a builder; a surfactant selected from: the formula $R^1(EO)_a(PO)_b(BO)_c$, wherein $R^1$ is a linear or branched $C_6$ to $C_{30}$ alkyl, a is from 2 to 30; b is from 0 to 30; c is from 1 to 30; and the surfactant has an X/Y number less than 1.90; the formula $R^1O[CH_2CH(R^3)O]_4R^2$, wherein $R^1$ is a hydrocarbon radical having from 1 to 30 carbon atoms; $R^2$ is a hydrocarbon radical having 1 to 30 carbon atoms: $R^3$ is H, or a linear aliphatic hydrocarbon-radical having from 1 to 4 carbon atoms; e is an integer having an average value from 1 to 40, a bleaching agent and d) adjunct materials.

23 Claims, No Drawings

AUTOMATIC DISHWASHING COMPOSITIONS COMPRISING SELECTED NONIONIC SURFACTANTS

This application claims priority to PCT/US00/0345, filed Feb. 10, 2000 and to U.S. provisional application No. 60/121,034, filed Feb. 22, 1999.

TECHNICAL FIELD

The present invention is in the field of automatic dishwashing detergents comprising nonionic surfactants and preferably bleach.

BACKGROUND OF THE INVENTION

Automatic dishwashing, particularly in domestic appliances, is an art very different from fabric laundering. Domestic fabric laundering is normally done in purpose-built machines having a tumbling action. These are very different from spray-action domestic automatic dishwashing appliances. The spray action in the latter tends to cause foam. Foam can easily overflow the low sills of domestic dishwashers and slow down the spray action, which in turn reduces the cleaning action. Thus in the distinct field of domestic machine dishwashing, the use of common foam-producing laundry detergent surfactants is normally restricted. These aspects are but a brief illustration of the unique formulation constraints in the domestic dishwashing field.

Automatic dishwashing with bleaching chemicals is different from fabric bleaching. In automatic dishwashing, use of bleaching chemicals involves promotion of soil removal from dishes, though soil bleaching may also occur. Additionally, soil antiredeposition and anti-spotting effects from bleaching chemicals are desirable. Some bleaching chemicals (such as a hydrogen peroxide source, alone or together with tetaacetylethylenediamine, aka "TAED") can, in certain circumstances, be helpful for cleaning dishware On account of the foregoing technical constraints as well as consumer needs and demands, automatic dishwashing detergent (ADD) compositions are undergoing continual change and improvement. Moreover environmental factors such as the restriction of phosphate, the desirability of providing ever-better spot filming results with less product, providing less thermal energy, and less water to assist the washing process, have all driven the need for improved ADD compositions.

In spite of such continuing changes to the formulation of ADD compositions, there continues to be a need for better cleaning ADD compositions, especially for elimination of spot filming. Typically, in other types of cleaning compositions such as laundry detergent compositions, cleaning improvements are continually being made by changing and improving the surfactants used. However, as noted hereinbefore, ADD compositions have the unique limitation of requiring very low sudsing compositions which is incompatible with most of the surfactant systems and ingredients typically used in other cleaning compositions. Thus, there continues to be a need for ADD compositions which provide spotting reduction benefits without unacceptably high sudsing.

BACKGROUND ART

U.S. Pat. No. 4,272,394, WO 94/22800, and WO 93/04153.

SUMMARY OF THE INVENTION

It has now been surprisingly discovered that automatic dishwashing detergent ("ADD") compositions comprising builder and a butoxy capped nonionic surfactant system, preferably further comprising a bleaching agent and/or enzymes, provide superior spotting reduction benefits.

The present invention therefore encompasses automatic dishwashing detergent compositions comprising:

(a) from about 5% to about 90% (preferably from about 5% to about 75%, more preferably from about 10% to about 50%) by weight of the composition of a builder (preferably phosphate or nil-phosphate builder systems containing citrate and carbonate);

(b) from about 0.1% to about 15% (preferably from about 0.2% to about 10%, more preferably from about 0.5% to about 5%) by weight of the composition of from about 0.1% to about 15% by weight of the composition of a nonionic surfactant, wherein said nonionic surfactant selected from the group consisting of:

(i) a nonionic surfactant of the formula $$R^1(EO)_a(PO)_b(BO)_c$$

wherein $R^1$ is a linear or branched $C_6$ to $C_{20}$ alkyl; a is from about 2 to about 30; b is from 0 to about 30; c is from about 1 to about 30; and said nonionic surfactant has an X/Y number less than 1.90;

(ii) a nonionic surfactant of the formula:

$$R^1O[CH_2CH(R^3)O]_eR^2$$

wherein $R^1$ is a linear or branched, saturated or unsaturated, aliphatic or aromatic hydrocarbon radicals having from 1 to 30 carbon atoms; $R^2$ is a linear or branched, saturated or unsaturated, aliphatic or aromatic hydrocarbon radicals having from 1 to 30 carbon atoms, optionally containing from 1 to 5 hydroxy groups; and further optionally substituted with an ether group; $R^3$ is H, or a linear aliphatic hydrocarbon radical having from 1 to 4 carbon atoms; e is an integer having an average value from 1 to 40, wherein $R^2$ can optionally be alkoxylated, wherein said alkoxy is selected from ethoxy, propoxy, butyloxy and mixtures thereof; and (iii) mixtures thereof;

(c) optionally, from about 0.1% to about 40% by weight of the composition of a bleaching agent (preferably a hypochlorite, e.g., sodium dichloroisocyanurate, "NaDCC", or source of hydrogen peroxide bleaching system, e.g. perborate or percarbonate), preferably also containing a cobalt bleach catalyst and/or a manganese bleach catalyst; and (d) adjunct materials, preferably automatic dishwashing detergent adjunct materials selected from the group consisting of enzymes, surfactants other than (b) chelating agents, and mixtures thereof.

The present invention encompasses (but is not limited to) granular-form, fully-formulated ADD's in which additional ingredients, including other enzymes (especially proteases and/or amylases) are formulated, along with other ADD product forms such as liquid gels and tablets.

The instant invention also encompasses cleaning methods; more particularly, a method of washing tableware in a domestic automatic dishwashing appliance, comprising treating the soiled tableware in an automatic dishwasher with an aqueous alkaline bath comprising an ADD composition as provided hereinbefore.

As already noted, the invention has advantages, including the excellent greasy soil removal, good dishcare, and good overall cleaning.

All parts, percentages and ratios used herein are expressed as percent weight unless otherwise specified. All documents cited are, in relevant part, incorporated herein by reference.

DETAILED DESCRIPTION OF THE INVENTION

Automatic Dishwashing Compositions:

Automatic dishwashing compositions of the present invention comprise builder and a butoxy capped nonionic surfactant system, and preferably also include a bleaching agent (such as a chlorine bleach or a source of hydrogen peroxide) and/or detersive enzymes. Bleaching agents useful herein include chlorine oxygen bleaches (e.g., hypochlorite or NaDCC) and sources of hydrogen peroxide, including any common hydrogen-peroxide releasing salt, such as sodium perborate, sodium percarbonate, and mixtures thereof. Also useful are sources of available oxygen such as persulfate bleach (e.g., OXONE, manufactured by DuPont). In the preferred embodiments, additional ingredients such as water-soluble silicates (useful to provide alkalinity and assist in controlling corrosion), dispersant polymers (which modify and inhibit crystal growth of calcium and/or magnesium salts), chelants (which control transition metals), alkalis (to adjust pH), and detersive enzymes (to assist with tough food cleaning, especially of starchy and proteinaceous soils), are present. Additional bleach-modifying materials such as conventional bleach activators (e.g. TAED and/or bleach catalysts) may be added, provided that any such bleach-modifying materials are delivered in such a manner as to be compatible with the purposes of the present invention. The present detergent compositions may, moreover, comprise one or more processing aids, fillers, perfumes, conventional enzyme particle-making materials including enzyme cores or "nonpareils", as well as pigments, and the like.

In general, materials used for the production of ADD compositions herein are preferably checked for compatibility with spotting/filming on glassware. Test methods for spotting/filming are generally described in the automatic dishwashing detergent literature, including DIN and ASTM test methods. Certain oily materials, especially at longer chain lengths, and insoluble materials such as clays, as well as long-chain fatty acids or soaps which form soap scum are therefore preferably limited or excluded from the instant compositions.

Amounts of the essential ingredients can vary within wide ranges, however preferred automatic dishwashing detergent compositions herein (which typically have a 1% aqueous solution pH of above about 8, more preferably from about 9.5 to about 12, most preferably from about 9.5 to about 10.5) are those wherein there is present: from about 5% to about 90%, preferably from about 5% to about 75%, of builder; from about 0.1% to about 15%, preferably from about 0.2% to about 10%, of the nonionic surfactant. Such fully-formulated embodiments typically further comprise from about 0.1% to about 15% of a polymeric dispersant, from about 0.01% to about 10% of a chelant, and from about 0.00001% to about 10% of a detersive enzyme, though further additional or adjunct ingredients may be present. Detergent compositions herein in granular form typically limit water content, for example to less than about 7% free water, for best storage stability.

While the present invention compositions may be formulated using chlorine-containing bleach additive, preferred ADD compositions of this invention (especially those comprising detersive enzymes) are substantially free of chlorine bleach. By "substantially free" of chlorine bleach is meant that the formulator does not deliberately add a chlorine-containing bleach additive, such as a dichloroisocyanurate, to the preferred ADD composition. However, it is recognized that because of factors outside the control of the formulator, such as chlorination of the water supply, some non-zero amount of chlorine bleach may be present in the wash liquor. The term "substantially free" can be similarly constructed with reference to preferred limitation of other ingredients.

By "effective amount" herein is meant an amount which is sufficient, under whatever comparative test conditions are employed, to enhance cleaning of a soiled surface. Likewise, the term "catalytically effective amount" refers to an amount of metal-containing bleach catalyst which is sufficient under whatever comparative test conditions are employed, to enhance cleaning of the soiled surface. In automatic dishwashing, the soiled surface may be, for example, a porcelain cup with tea stain, a porcelain cup with lipstick stain, dishes soiled with simple starches or more complex food soils, or a plastic spatula stained with tomato soup. The test conditions will vary, depending on the type of washing appliance used and the habits of the user. Some machines have considerably longer wash cycles than others. Some users elect to use warm water without a great deal of heating inside the appliance; others use warm or even cold water fill, followed by a warm-up through a built-in electrical coil. Of course, the performance of bleaches and enzymes will be affected by such considerations, and the levels used in fully-formulated detergent and cleaning compositions can be appropriately adjusted.

Selected Nonionic Surfactant System

The essential nonionic surfactants of the present invention must have an X/Y number of less than 1.90, preferably less than 1.85, more preferably less than 1.75. The determination of this X/Y number is described hereinafter.

The nonionic surfactants of the present invention are selected from the group consisting of:

(i) a nonionic surfactant of the formula $$R^1(EO)_a(PO)_b(BO)_c$$

wherein R1 is a linear or branched C6 to C20 alkyl, preferably linear or branched C8 to C18 alkyl, more preferably linear or branched C9 to C16 alkyl; a is an integer from 2 to 30, preferably from 4 to 25, more preferably from 5 to 20 most preferably from 5 to 18; b is an integer from 0 to 30 preferably from 0 to 25, more preferably from 0 to 20, most preferably from 0 to 10; c is an integer from 1 to 30 preferably from 1 to 15, more preferably from 1 to 10, most preferably from 1 to 6;

(ii) a nonionic surfactant of the formula:

$$R^1O[CH_2CH(R^3)O]_eR^2$$

wherein $R^1$ is a linear or branched, saturated or unsaturated, aliphatic or aromatic hydrocarbon radicals having from 1 to 30 carbon atoms; $R^2$ is a linear or branched, saturated or unsaturated, aliphatic or aromatic hydrocarbon radicals having from 1 to 30 carbon atoms, optionally containing from 1 to 5 hydroxy groups; and further optionally substituted with an ether group; $R^3$ is H, or a linear aliphatic hydrocarbon radical having from 1 to 4 carbon atoms; e is an integer having an average value from 1 to 40, wherein $R^2$ can optionally be alkoxylated, wherein said alkoxy is selected from ethoxy, propoxy, butyloxy and mixtures thereof; and (iii) mixtures thereof;

Suitable surfactants include, but are not limited to,

| Surfactant | X/Y value |
|---|---|
| C9,11PO3EO13BO6 | 1.41 |
| C9,11PO3EO13BO3 | 1.70 |
| C9,11EO13BO6 | 1.49 |
| C9,11EO13BO3 | 1.88 |
| C9,11BO1EO13BO3 | 1.72 |
| C9,11EO8BO3 | 1.29 |
| C12,15EO7BO2 | 1.03 |
| C9,11EO8BO2 | 1.41 |
| C9,11EO8BO1 | 1.58 |
| C12,13EO6.5T*BO1 | 1.10 |

*Denotes topped, or narrow selection of EO distribution.

Calculation of X/Y

The LFNI surfactants of the present invention must all have a ratio of hydrophobic to hydrophilic, or "X/Y" number of greater than or equal to 1.00.

The calculation of "X/Y" is as follows. For a given alkoxylated nonionic surfactant structure, "X" is defined as the sum of the protons attached to carbon atoms that are adjacent to oxygen. "Y" is defined as the sum of all the protons attached to carbon atoms within said molecule that are non-adjacent to oxygen. That is,

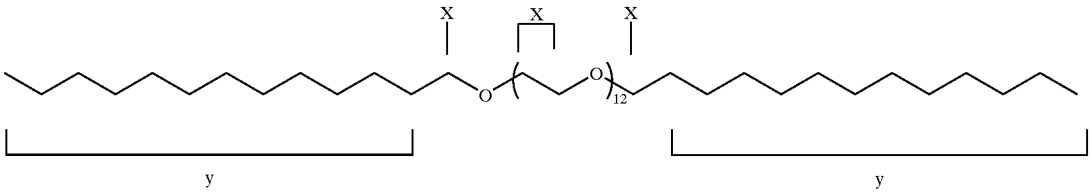

A typical example is shown below. For $C_{13}EO_{12}C_{13}$, X=52 and Y=50. Therefore, X/Y=52/50=1.04.

X/Y can also be measured experimentally from integration of the H NMR spectrum. The "X" protons are represented as the peak area defined by the region of the spectrum from d 3.0 to 4.0 ppm. The "Y" protons are represented as the peak area defined from d 0.5 to 2.0 ppm. X/Y is then calculated by dividing the peak area from 3.0 to 4.0 ppm by the peak area from 0.5 to 2.0 ppm.

Preferred are ADD compositions comprising nonionic surfactant systems wherein the sudsing (absent any silicone suds controlling agent) is less than 2 inches, preferably less than 1 inch, determined as by the method disclosed in U.S. Pat. No. 5,294,365.

Optional Co-Surfactants—The composition of the present invention may further contain optional co-surfactants. These optional surfactants will be preferably bleach stable. Preferred optional co-surfactants are low cloud point nonionic surfactants, high cloud point nonionic surfactants, anionic surfactants and mixtures thereof.

Nonionic co-surfactants useful in the present invention Automatic Dishwashing compositions are when present desirably included in the present detergent compositions at levels of from about 0.1% to about 15% of the composition. In general, bleach-stable co-surfactants are preferred. Nonionic surfactants generally are well known, being described in more detail in Kirk Othmer's Encyclopedia of Chemical Technology, 3rd Ed., Vol. 22, pp. 360–379, "Surfactants and Detersive Systems", incorporated by reference herein.

"Cloud point", as used herein, is a well known property of nonionic surfactants which is the result of the surfactant becoming less soluble with increasing temperature, the temperature at which the appearance of a second phase is observable is referred to as the "cloud point" (See Kirk Othmer, pp. 360–362, hereinbefore).

As used herein, a "low cloud point" nonionic co-surfactant is defined as a nonionic surfactant system ingredient having a cloud point of less than 30° C., preferably less than about 20° C., and most preferably less than about 10° C. Typical low cloud point nonionic co-surfactants include nonionic alkoxylated surfactants, especially ethoxylates derived from primary alcohol, and polyoxypropylene/polyoxyethylene/polyoxypropylene (PO/EO/PO) reverse block polymers. Also, such low cloud point nonionic co-surfactants include, for example, ethoxylated-propoxylated alcohol (e.g., Olin Corporation's Poly-Tergent® SLF18) and epoxy-capped poly(oxyalkylated) alcohols (e.g., Olin Corporation's Poly-Tergent® SLF18B series of nonionics, as described, for example, in WO 94/22800, published Oct. 13, 1994 by Olin Corporation).

Nonionic co-surfactants can optionally contain propylene oxide in an amount up to about 15% by weight. Other preferred nonionic co-surfactants can be prepared by the processes described in U.S. Pat. No. 4,223,163, issued September 16, 1980, Builloty, incorporated herein by reference.

Low cloud point nonionic co-surfactants additionally comprise a polyoxyethylene, polyoxypropylene block polymeric compound. Block polyoxyethylene-polyoxypropylene-polymeric compounds include those based on ethylene glycol, propylene glycol, glycerol, trimethylolpropane and ethylenediamine as initiator reactive hydrogen compound. Certain of the block polymer surfactant compounds designated PLURONIC®, REVERSED PLURONIC®, and TETRONIC® by the BASF-Wyandotte Corp., Wyandotte, Mich., are suitable in ADD compositions of the invention. Preferred examples include REVERSED PLURONIC® 25R2 and TETRONIC® 702, Such co-surfactants are typically useful herein as low cloud point nonionic surfactants.

As used herein, a "high cloud point" nonionic co-surfactant is defined as a nonionic surfactant system ingredient having a cloud point of greater than 40° C., preferably greater than about 50° C., and more preferably greater than about 60° C. Preferably the nonionic co-surfactant system comprises an ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis. Such high cloud point nonionic co-surfactants include, for example, Tergitol 15S9 (supplied by Union Carbide), Rhodasurf TMD 8.5 (supplied by Rhone Poulenc), and Neodol 91-8 (supplied by Shell).

It is also preferred for purposes of the present invention that the high cloud point nonionic co-surfactant further have a hydrophile-lipophile balance ("HLB"; see Kirk Othmer hereinbefore) value within the range of from about 9 to about 15, preferably 11 to 15. Such materials include, for example, Tergitol 15S9 (supplied by Union Carbide), Rhodasurf TMD 8.5 (supplied by Rhone Poulenc), and Neodol 91 -8 (supplied by Shell).

Another preferred high cloud point nonionic co-surfactant is derived from a straight or preferably branched chain or secondary fatty alcohol containing from about 6 to about 20 carbon atoms ($C_6$–$C_{20}$ alcohol), including secondary alcohols and branched chain primary alcohols. Preferably, high cloud point nonionic co-surfactants are branched or secondary alcohol ethoxylates, more preferably mixed C9/11 or C 11/15 branched alcohol ethoxylates, condensed with an average of from about 6 to about 15 moles, preferably from about 6 to about 12 moles, and most preferably from about 6 to about 9 moles of ethylene oxide per mole of alcohol. Preferably the ethoxylated nonionic co-surfactant so derived has a narrow ethoxylate distribution relative to the average.

When the optional co-surfactants are a mixture of low cloud point nonionics and high cloud point nonionics it is preferred that the mixture is combined in a weight ratio preferably within the range of from about 10:1 to about 1:10.

The anionic co-surfactant may be selected from alkylethoxycarboxylates, alkylethoxysulfates, with the degree of ethoxylation greater than 3 (preferably 4 to 10; more preferably 6 to 8), and chain length in the range of C8 to C16, preferably 11–15. Additionally, branched alkylcarboxylates have been found to be useful in ADW compositions when the branch occurs in the middle and the average total chain length is 10 to 18, preferably 12–16 with the side branch 2–4 carbons in length. An example is 2- butyloctanoic acid. The anionic co-surfactant is typically of a type having good solubility in the presence of calcium. Such anionic co-surfactants are further illustrated by alkyl (polyethoxy)sulfates (AES), alkyl (polyethoxy)carboxylates (AEC), and short chained $C_6$–$C_{10}$ alkyl sulfates and sulfonates. Straight chain fatty acids have been shown to be ineffective due to their sensitivity to calcium.

Builders

Detergent builders other than silicates can optionally be included in the compositions herein to assist in controlling mineral hardness. Inorganic as well as organic builders can be used. Builders are used in automatic dishwashing to assist in the removal of particulate soils.

The level of builder can vary widely depending upon the end use of the composition and its desired physical form. The compositions will typically comprise at least about 1% builder. High performance compositions typically comprise from about 5% to about 90%, more typically from about 5% to about 75% by weight, of the detergent builder. Lower or higher levels of builder, however, are not excluded.

Inorganic or non-phosphate-containing detergent builders include, but are not limited to, phosphonates, phytic acid, silicates, carbonates (including bicarbonates and sesquicarbonates), sulfates, citrate, zeolite or layered silicate, and aluminosilicates.

Examples of carbonate builders are the alkaline earth and alkali metal carbonates as disclosed in German Patent Application No. 2,321,001 published on Nov. 15, 1973. Various grades and types of sodium carbonate and sodium sesquicarbonate may be used, certain of which are particularly useful as carriers for other ingredients, especially detersive surfactants.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediaminetetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty laundry detergent and automatic dishwashing formulations due to their availability from renewable resources and their biodegradability. Citrates can also be used in combination with zeolite, the aforementioned BRITESIL types, and/or layered silicate builders. Oxydisuccinates are also useful in such compositions and combinations.

Also suitable in the detergent compositions of the present invention are the 3,3-dicarboxy-4-oxa-1,6-hexanedionates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also U.S. Pat. No. 3,723,322.

Fatty acids, e.g., $C_{12}$–$C_{18}$ monocarboxylic acids, may also be incorporated into the compositions alone, or in combination with the aforesaid builders, especially citrate and/or the succinate builders, to provide additional builder activity but are generally not desired. Such use of fatty acids will generally result in a diminution of sudsing in laundry compositions, which may need to be taken into account by the formulator. Fatty acids or their salts are undesirable in Automatic Dishwashing (ADD) embodiments in situations wherein soap scums can form and be deposited on dishware.

Where phosphorus-based builders can be used, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used though such materials are more commonly used in a low-level mode as chelants or stabilizers.

Phosphate detergent builders for use in ADD compositions are well known. They include, but are not limited to, the alkali metal, ammonium and alkanolammonium salts of polyphosphates (exemplified by the tripolyphosphates, pyrophosphates, and glassy polymeric meta-phosphates). Phosphate builder sources are described in detail in Kirk Othmer, 3rd Edition, Vol. 17, pp. 426–472 and in "Advanced Inorganic Chemistry" by Cotton and Wilkinson, pp. 394–400 (John Wiley and Sons, Inc.; 1972).

Preferred levels of phosphate builders herein are from about 10% to about 75%, co preferably from about 15% to about 50%, of phosphate builder.

Bleaching Agents

Hydrogen peroxide sources are described in detail in the herein incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms. An "effective amount" of a source of hydrogen peroxide is any amount capable of measurably improving stain removal (especially of tea stains) from soiled dishware compared to a hydrogen peroxide source-free composition when the soiled dishware is washed by the consumer in a domestic automatic dishwasher in the presence of alkali.

More generally a source of hydrogen peroxide herein is any convenient compound or mixture which under consumer use conditions provides an effective amount of hydrogen peroxide. Levels may vary widely and are usually in the range from about 0.1% to about 70%, more typically from about 0.5% to about 30%, by weight of the ADD compositions herein.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Also useful are sources of available oxygen such as persulfate bleach (e.g., OXONE, manufactured by DuPont). Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

While not preferred for ADD compositions of the present invention which comprise detersive enzymes, the present invention compositions may also comprise as the bleaching agent a chlorine-type bleaching material. Such agents are well known in the art, and include for example sodium dichloroisocyanurate ("NaDCC").

While effective ADD compositions herein may comprise only the nonionic surfactant system and builder, fully-formulated ADD compositions typically will also comprise other automatic dishwashing detergent adjunct materials to improve or modify performance. These materials are selected as appropriate for the properties required of an automatic dishwashing composition. For example, low spotting and filming is desired—preferred compositions have spotting and filming grades of 3 or less, preferably less than 2, and most preferably less than 1, as measured by the standard test of The American Society for Testing and Materials ("ASTM") D3556-85 (Reapproved 1989) "Standard Test Method for Deposition on Glassware During Mechanical Dishwashing".

Adjunct Materials:

Detersive ingredients or adjuncts optionally included in the instant compositions can include one or more materials for assisting or enhancing cleaning performance, treatment of the substrate to be cleaned, or designed to improve the aesthetics of the compositions. They are further selected based on the form of the composition, i.e., whether the composition is to be sold as a liquid, paste (semi-solid), or solid form (including tablets and the preferred granular forms for the present compositions). Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as non-phosphate builders, chelants, enzymes, suds suppressors, dispersant polymers (e.g., from BASF Corp. or Rohm & Haas), color speckles, silvercare, anti-tarnish and/or anti-corrosion agents, dyes, fillers, germicides, alkalinity sources, hydrotropes, anti-oxidants, enzyme stabilizing agents, perfumes, solubilizing agents, carriers, processing aids, pigments, pH control agents, and, for liquid formulations, solvents, as described in detail hereinafter.

1. Detersive Enzymes

Detergent compositions of the present invention may further comprise one or more enzymes which provide cleaning performance benefits. "Detersive enzyme", as used herein, means any enzyme having a cleaning, stain removing or otherwise beneficial effect in an ADD composition. Such detersive enzymes include enzymes selected from cellulases, hemicellulases, peroxidases, proteases, glucoamylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a detergent composition having a cocktail of conventional applicable enzymes like protease, amylase, lipase, cutinase and/or cellulase. Enzymes when present in the compositions, at from about 0.0001% to about 5% of active enzyme by weight of the detergent composition. Highly preferred for automatic dishwashing are amylases and/or proteases, including both current commercially available types and improved types which, though more bleach compatible, have a remaining degree of bleach deactivation susceptibility.

Proteolytic Enzyme—The proteolytic enzyme can be of animal, vegetable or microorganism (preferred) origin. The proteases for use in the detergent compositions herein include (but are not limited to) trypsin, subtilisin, chymotrypsin and elastase-type proteases. Preferred for use herein are subtilisin-type proteolytic enzymes. Particularly preferred is bacterial serine proteolytic enzyme obtained from *Bacillus subtilis* and/or *Bacillus licheniformis*.

Suitable proteolytic enzymes include Novo Industri A/S Alcalase® (preferred), Esperase®, Savinase®

(Copenhagen, Denmark), Gist-brocades' Maxatase®, Maxacal® and Maxapem 15® (protein engineered Maxacal®) (Delft, Netherlands), and subtilisin BPN and BPN' (preferred), which are commercially available. Preferred proteolytic enzymes are also modified bacterial serine proteases, such as those made by Genencor International, Inc. (San Francisco, Calif.) which are described in European Patent 251,446B, granted Dec. 28, 1994 (particularly pages 17, 24 and 98) and which are also called herein "Protease B". U.S. Pat. No. 5,030,378, Venegas, issued Jul. 9, 1991, refers to a modified bacterial serine proteolytic enzyme (Genencor International) which is called "Protease A" herein (same as BPN). In particular see columns 2 and 3 of U.S. Pat. No. 5,030,378 for a complete description, including amino sequence, of Protease A and its variants. Other proteases are sold under the tradenames: Primase, Durazym, Opticlean and Optimase. Preferred proteolytic enzymes, then, are selected from the group consisting of Alcalase® (Novo Industri A/S), BPN, Protease A and Protease B (Genencor), and mixtures thereof Protease B is most preferred.

Of particular interest for use herein are the proteases described in U.S. Pat. No. 5,470,733.

Also proteases described in WO95/10591 can be included in the detergent composition of the invention.

Another preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens subtilisin,* as described in WO 95/10615 published Apr. 20, 1995 by Genencor International (A. Baeck et al. entitled "Protease-Containing Cleaning Compositions" having U.S. Ser. No. 08/322,676, filed Oct. 13, 1994).

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Protease enzyme may be incorporated into the compositions in accordance with the invention at a level of from 0.0001% to 2% active enzyme by weight of the composition.

Amylase—Amylases (α and/or β) can be included for removal of carbohydrate-based stains. Suitable amylases are Termamyl® (Novo Nordisk), Fungamyl® and BAN® (Novo Nordisk). The enzymes may be of any suitable origin, such as vegetable, animal, bacterial, fungal and yeast origin. Amylase enzymes are normally incorporated in the detergent composition at levels from 0.0001% to 2%, preferably from about 0.0001% to about 0.5%, more preferably from about 0.0005% to about 0.1%, even more preferably from about 0.001% to about 0.05% of active enzyme by weight of the detergent composition.

Amylase enzymes also include those described in WO95/26397 and in WO 96/23873.

One suitable amylase enzyme is NATALASE® available from Novo Nordisk.

Other amylases suitable herein include, for example, α-amylases described in GB 1,296,839 to Novo; RAPDASE®, International Bio-Synthetics, Inc. and TERMAMYL®, Novo. FUNGAMYL® from Novo is especially useful.

Particularly preferred amylases herein include amylase variants having additional modification in the immediate parent as described in WO 9510603 A and are available from the assignee, Novo, as DURAMYL®. Other particularly preferred oxidative stability enhanced amylase include those described in WO 9418314 to Genencor International and WO 9402597 to Novo. Any other oxidative stability-enhanced amylase can be used, for example as derived by site-directed mutagenesis from known chimeric, hybrid or simple mutant parent forms of available amylases. Other preferred enzyme modifications are accessible. See WO 9509909 A to Novo.

Various carbohydrase enzymes which impart antimicrobial activity may also be included in the present invention. Such enzymes include endoglycosidase, Type II endoglycosidase and glucosidase as disclosed in U.S. Pat. Nos. 5,041,236, 5,395,541, 5,238,843 and 5,356,803 the disclosures of which are herein incorporated by reference. Of course, other enzymes having antimicrobial activity may be employed as well including peroxidases, oxidases and various other enzymes.

It is also possible to include an enzyme stabilization system into the compositions of the present invention when any enzyme is present in the composition.

Peroxidase enzymes can be used in combination with oxygen sources, e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Optional Bleach Adjuncts (a) Bleach Activators—

Preferably, the per oxygen bleach component in the composition is formulated with an activator (peracid precursor). The activator is present at levels of from about 0.01% to about 15%, preferably from about 0.5% to about 10%, more preferably from about 1% to about 8%, by weight of the composition. Preferred activators are selected from the group consisting of tetraacetyl ethylene diamine (TAED), benzoylcaprolactam (BzCL), 4-nitrobenzoylcaprolactam, 3-chlorobenzoylcaprolactam, benzoyloxybenzenesulphonate (BOBS), nonanoyloxybenzenesulphonate (NOBS), phenyl benzoate (PhBz), decanoyloxybenzenesulphonate ($C_{10}$-OBS), benzoylvalerolactam (BZVL), octanoyloxybenzenesulphonate ($C_8$-OBS), perhydrolyzable esters and mixtures thereof, most preferably benzoylcaprolactam and benzoylvalerolactam. Particularly preferred bleach activators in the pH range from about 8 to about 9.5 are those selected having an OBS or VL leaving group.

Preferred bleach activators are those described in U.S. Pat. No. 5,130,045, Mitchell et al, and 4,412,934, Chung et al, WO94/28103. WO/9428102 WO 94/27970. W 94/28104, U.S. Pat. No. 5,348,136 and copending patent application U.S. Ser. No. 08/064,621, and WO 94/28106, all of which are incorporated herein by reference.

The mole ratio of per oxygen bleaching compound (as AvO) to bleach activator in the present invention generally ranges from at least 1:1, preferably from about 20:1 to about 1:1, more preferably from about 10:1 to about 3:1.

(b) Organic Peroxides, especially Diacyl Peroxides—These are extensively illustrated in Kirk Othmer, Encyclopedia of Chemical Technology, Vol. 17, John Wiley and Sons, 1982 at pages 27–90 and especially at pages 63–72, all incorporated herein by reference.

Quaternary substituted bleach activators may also be included. The present detergent compositions preferably comprise a quaternary substituted bleach activator (QSBA) or a quaternary substituted peracid (QSP); more preferably, the former. Preferred QSBA structures are further described in U.S. Pat. Nos. 5,606,015, 5,460,747, 5,584,888 and 5,578,136. incorporated herein by reference.

(b) Organic Peroxides, especially Diacyl Peroxides

These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

(c) Metal-containing Bleach Catalysts:

The present invention compositions and methods utilize metal-containing bleach catalysts that are effective for use in ADD compositions. Preferred are manganese and cobalt-containing bleach catalysts.

For examples of suitable bleach catalysts see U.S. Pat. Nos. 4,246,612, 5,804,542, 5,798,326, 5,246,621, 4,430,243, 5,244,594, 5,597,936, 5,705,464, 4,810,410, 4,601,845, 5,194,416, 5,703,030, 4,728,455, 4,711,748, 4,626,373, 4,119,557, 5,114,606, 5,599,781, 5,703,034, 5,114,611, 4,430,243, 4,728,455, and 5,227,084; EP Pat. Nos. 408,131, 549,271, 384,503, 549,272, 224,952, and 306,089; DE Pat. No. 2,054,019; CA Pat No. 866,191.

Preferred are cobalt (III) catalysts having the formula:

$$Co[(NH_3)_nM'_mB'_bT'_tQ_qP_p]Y_y$$

wherein cobalt is in the +3 oxidation state; n is an integer from 0 to 5 (preferably 4 or 5; most preferably 5); M' represents a monodentate ligand; m is an integer from 0 to 5 (preferably 1 or 2; most preferably 1); B' represents a bidentate ligand; b is an integer from 0 to 2; T' represents a tridentate ligand; t is 0 or 1; Q is a tetradentate ligand; q is 0 or 1; P is a pentadentate ligand; p is 0 or 1; and n+m+2b+3t+4q+5p=6; Y is one or more appropriately selected counteranions present in a number y, where y is an integer from 1 to 3 (preferably 2 to 3; most preferably 2 when Y is a −1 charged anion), to obtain a charge-balanced salt, preferred Y are selected from the group consisting of chloride, iodide, $I_3$—, formate, nitrate, nitrite, sulfate, sulfite, citrate, acetate, carbonate, bromide, $PF_6$—, $BF_4$—, $B(Ph)_4$—, phosphate, phosphite, silicate, tosylate, methanesulfonate, and combinations thereof [optionally, Y can be protonated if more than one anionic group exists in Y, e.g., $HPO_4^{2}$—, $HCO_3$—, $H_2PO_4$—, etc., and further, Y may be selected from the group consisting of non-traditional inorganic anions such as anionic surfactants, e.g., linear alkylbenzene sulfonates (LAS), alkyl sulfates (AS), alkylethoxysulfonates (AES), etc., and/or anionic polymers, e.g., polyacrylates, polymethacrylates, etc.]; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than about 0.4 volts (preferably less than about 0.2 volts) versus a normal hydrogen electrode.

Preferred cobalt catalysts of this type have the formula:

$$[Co(NH_3)_n(M')_m]Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]Y_y$, and especially $[Co(NH_3)_5Cl]Cl_{22}$.

More preferred are the present invention compositions which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counteranions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}s^{-1}$ (25° C.).

The most preferred cobalt catalyst useful herein are cobalt pentaamine acetate salts having the formula $[Co(NH_3)_5OAc]T_y$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$.

As a practical matter, and not by way of limitation, the cleaning compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic dishwashing process, typical automatic dishwashing compositions herein will comprise from about 0.0005% to about 0.2%, more preferably from about 0.004% to about 0.08%, of bleach catalyst by weight of the cleaning compositions.

4. pH and Buffering Variation

Many detergent compositions herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

The preferred ADD compositions herein comprise a pH-adjusting component selected from water-soluble alkaline inorganic salts and water-soluble organic or inorganic builders. The pH-adjusting components are selected so that when the ADD is dissolved in water at a concentration of 1,000–10,000 ppm, the pH remains in the range of above about 8, preferably from about 9.5 to about 11. The preferred nonphosphate pH-adjusting component of the invention is selected from the group consisting of:

(i) sodium carbonate or sesquicarbonate;

(ii) sodium silicate, preferably hydrous sodium silicate having $SiO_2$:$Na_2O$ ratio of from about 1:1 to about 2:1, and mixtures thereof with limited quantites of sodium metasilicate;

(iii) sodium citrate;

(iv) citric acid;

(v) sodium bicarbonate;

(vi) sodium borate, preferably borax;

(vii) sodium hydroxide; and (viii) mixtures of (i)–(vii).

Preferred embodiments contain low levels of silicate (i.e. from about 3% to about 10% $SiO_2$).

Illustrative of highly preferred pH-adjusting component systems are binary mixtures of granular sodium citrate with anhydrous sodium carbonate, and three-component mixtures of granular sodium citrate trihydrate, citric acid monohydrate and anhydrous sodium carbonate.

The amount of the pH adjusting component in the instant ADD compositions is preferably from about 1% to about 50%, by weight of the composition. In a preferred embodiment, the pH-adjusting component is present in the ADD composition in an amount from about 5% to about 40%, preferably from about 10% to about 30%, by weight.

For compositions herein having a pH between about 9.5 and about 11 of the initial. wash solution, particularly preferred ADD embodiments comprise, by weight of ADD, from about 5% to about 40%, preferably from about 10% to about 30%, most preferably from about 15% to about 20%, of sodium citrate with from about 5% to about 30%, preferably from about 7% to 25%, most preferably from about 8% to about 20% sodium carbonate.

The essential pH-adjusting system can be complemented (i.e. for improved sequestration in hard water) by other optional detergency builder salts selected from nonphosphate detergency builders known in the art, which include the various water-soluble, alkali metal, ammonium or substituted ammonium borates, hydroxysulfonates, polyacetates, and polycarboxylates. Preferred are the alkali metal,-especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid; nitrilotriacetic acid, tartrate monosuccinic acid, tartrate disuccinic acid, oxydisuccinic acid, carboxymethoxysuccinic acid, mellitic acid, and sodium benzene polycarboxylate salts.

(a) Water-Soluble Silicates

The present automatic dishwashing detergent compositions may further comprise water-soluble silicates. Water-soluble silicates herein are any silicates which are soluble to the extent that they do not adversely affect spotting/filming characteristics of the ADD composition.

Examples of silicates are sodium metasilicate and, more generally, the alkali metal silicates, particularly those having a $SiO_2$:$Na_2O$ ratio in the range 1.6:1 to 3.2:1; and layered silicates, such as the layered sodium silicates described in U.S. Pat. No. 4,664,839, issued May 12, 1987 to H. P. Rieck. NaSKS-6® is a crystalline layered silicate marketed by Hoechst (commonly abbreviated herein as "SKS-6"). Unlike zeolite builders, Na SKS-6 and other water-soluble silicates useful herein do not contain aluminum. NaSKS-6 is the δ—$Na_2SiO_5$ form of layered silicate and can be prepared by methods such as those described in German DE-A-3,417,649 and DE-A-3,742,043. SKS-6 is a preferred layered silicate for use herein, but other such layered silicates, such as those having the general formula $NaMSi_xO_2x+1.yH_2O$ wherein M is sodium or hydrogen, x is a number from 1.9 to 4, preferably 2, and y is a number from 0 to 20, preferably 0 can be used. Various other layered silicates from Hoechst include NaSKS-5, NaSKS-7 and NaSKS-11, as the α-, β- and γ- forms. Other silicates may also be useful, such as for example magnesium silicate, which can serve as a crispening agent in granular formulations, as a stabilizing agent for oxygen bleaches, and as a component of suds control systems.

Silicates particularly useful in automatic dishwashing (ADD) applications include granular hydrous 2-ratio silicates such as BRITESILI® from PQ Corp., and the commonly sourced BRITESIL® H24 though liquid grades of various silicates can be used when the ADD composition has liquid form. Within safe limits, sodium metasilicte or sodium hydroxide alone or in combination with other silicates may be used in an ADD context to boost wash pH to a desired level.

6. Chelating Agents

The compositions herein may also optionally contain one or more transition-metal selective sequestrants, "chelants" or "chelating agents", e.g., iron and/or copper and/or manganese chelating agents. Chelating agents suitable for use herein can be selected from the group consisting of aminocarboxylates, phosphonates (especially the aminophosphonates), polyfunctionally-substituted aromatic chelating agents, and mixtures thereof. Without intending to be bound by theory, it is believed that the benefit of these materials is due in part to their exceptional ability to control iron, copper and manganese in washing solutions which are known to decompose hydrogen peroxide and/or bleach activators; other benefits include inorganic film prevention or scale inhibition. Commercial chelating agents for use herein include the DEQUEST® series, and chelants from Monsanto, DuPont, and Nalco, Inc.

Aminocarboxylates useful as optional chelating agents are further illustrated by ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts thereof. In general, chelant mixtures may be used for a combination of functions, such as multiple transition-metal control, long-term product stabilization, and/or control of precipitated transition metal oxides and/or hydroxides.

Polyfunctionally-substituted aromatic chelating agents are also useful in the compositions herein. See U.S. Pat. No.

3,812,044, issued May 21, 1974, to Connor et al. Preferred compounds of this type in acid form are dihydroxydisulfobenzenes such as 1,2-dihydroxy-3,5-isulfobenzene.

A highly preferred biodegradable chelator for use herein is ethylenediamine disuccinate ("EDDS"), especially (but not limited to) the [S,S] isomer as described in U.S. Pat. No. 4,704,233, Nov. 3, 1987, to Hartman and Perkins. The trisodium salt is preferred though other forms, such as magnesium salts, may also be useful.

Aminophosphonates are also suitable for use as chelating agents in the compositions of the invention when at least low levels of total phosphorus are acceptable in detergent compositions, and include the ethylenediaminetetrakis (methylenephosphonates) and the diethylenetriaminepentakis (methylene phosphonates). Preferably, these aminophosphonates do not contain alkyl or alkenyl groups with more than about 6 carbon atoms.

If utilized, chelating agents or transition-metal-selective sequestrants will preferably comprise from about 0.001% to about 10%, more preferably from about 0.05% to about 1% by weight of the compositions herein.

7. Dispersant Polymer—Preferred ADD compositions herein may additionally contain a dispersant polymer. When present, a dispersant polymer in the instant ADD compositions is typically at levels in the range from 0 to about 25%, preferably from about 0.5% to about 20%, more preferably from about 1% to about 8% by weight of the ADD composition. Dispersant polymers are useful for improved filming performance of the present ADD compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are further illustrated by the film-forming polymers described in U.S. Pat. No. 4,379,080 (Murphy), issued Apr. 5, 1983.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1,000 to about 500,000, more preferably is from about, 1,000 to about 250,000, and most preferably, especially if the ADD is for use in North American automatic dishwashing appliances, is from about 1,000 to about 5,000.

Other suitable dispersant polymers include those disclosed in U.S. Pat. No. 3,308,067 issued Mar. 7, 1967, to Diehl. Unsaturated monomeric acids that can be polymerized to form suitable dispersant polymers include acrylic acid; maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula:—$[(C(R^2)C(R^1)(C(O)OR^3)]$ wherein the apparently unfilled valencies are in fact occupied by hydrogen and at least one of the substituents $R^1$, $R^2$, or $R^3$, preferably $R^1$ or $R^2$, is a 1 to 4 carbon alkyl or hydroxyalkyl group; $R^1$ or $R^2$ can be a hydrogen and $R^3$ can be a hydrogen or alkali metal salt. Most preferred is a substituted acrylic monomer wherein $R^1$ is methyl, $R^2$ is hydrogen, and $R^3$ is sodium.

Suitable low molecular weight polyacrylate dispersant polymer preferably has a molecular weight of less than about 15,000, preferably from about 500 to about,10,000, most preferably from about 1,000 to about 5,000. The most preferred polyacrylate copolymer for use herein has a molecular weight of about 3,500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535.

Agglomerated forms of the present ADD compositions may employ aqueous solutions of polymer dispersants as liquid binders for making the agglomerate (particularly when the composition consists of a mixture of sodium citrate and sodium carbonate). Especially preferred are polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula:

$HO(CH_2CH_2O)_m(CH_2CH(CH_3)O)_n(CH(CH_3)CH_2O)_oOH$ wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDonald, issued Feb. 27, 1979. Preferred cellulose-derived dispersant polymers are the carboxymethyl celluloses.

Yet another group of acceptable dispersants are the organic dispersant polymers, such as polyaspartate.

8. Material Care Agents—The present ADD compositions may contain one or more material care agents which are effective as corrosion inhibitors and/or anti-tarnish aids. Such materials are preferred components of machine dishwashing compositions especially in certain European countries where the use of electroplated nickel silver and sterling silver is still comparatively common in domestic flatware, or when aluminium protection is a concern and the composition is low in silicate. Generally, such material care agents include metasilicate, silicate, bismuth salts, manganese salts, paraffin, triazoles, pyrazoles, thiols, mercaptans, aluminium fatty acid salts, and mixtures thereof.

When present, such protecting materials are preferably incorporated at low levels, e.g., from about 0.01% to about 5% of the ADD composition. Suitable corrosion inhibitors include paraffin oil, typically a predominantly branched aliphatic hydrocarbon having a number of carbon atoms in the range of from about 20 to about 50; preferred paraffin oil is selected from predominantly branched $C_{25-45}$ species with a ratio of cyclic to noncyclic hydrocarbons of about 32:68. A paraffin oil meeting those characteristics is sold by Wintershall, Salzbergen, Germany, under the trade name WINOG 70. Additionally, the addition of low levels of bismuth nitrate (i.e., $Bi(NO_3)_3$) is also preferred.

Other corrosion inhibitor compounds include benzotriazole and comparable compounds; mercaptans or thiols including thionaphtol and thioanthranol; and finely divided Aluminium fatty acid salts, such as aluminium tristearate. The formulator will recognize that such materials will generally be used judiciously and in limited quantities so as to avoid any tendency to produce spots or films on glassware or to compromise the bleaching action of the compositions. For this reason, mercaptan anti-tarnishes which are quite strongly bleach-reactive and common fatty carboxylic acids which precipitate with calcium in particular are preferably avoided.

9. Silicone and Phosphate Ester Suds Suppressors—The ADD's of the invention can optionally contain an alkyl phosphate ester suds suppressor, a silicone suds suppressor, or combinations thereof. Levels in general are from 0% to about 10%, preferably, from about 0.001% to about 5%. However, generally (for cost and/or deposition considerations) preferred compositions herein do not comprise suds suppressors or comprise suds suppressors only at low levels, e.g., less than about 0.1% of active suds suppressing agent.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

If it is desired to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof.

It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

10. Other Optional Adjuncts—Depending on whether a greater or lesser degree of compactness is required, filler materials can also be present in the instant ADDs. These include sucrose, sucrose esters, sodium sulfate, potassium sulfate, etc., in amounts up to about 70%, preferably from 0% to about 40% of the ADD composition. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates or EDDS in magnesium-salt form. Note that preferences, in terms of purity sufficient to avoid decomposing bleach, applies also to pH-adjusting component ingredients, specifically including any silicates used herein.

Although optionally present in the instant compositions, the present invention encompasses embodiments which are substantially free from sodium chloride or potassium chloride.

Hydrotrope materials such as sodium benzene sulfonate, sodium toluene sulfonate, sodium cumene sulfonate, etc., can be present, e.g., for better dispersing surfactant.

Bleach-stable perfumes (stable as to odor); and bleach-stable dyes such as those disclosed in U.S. Pat. No. 4,714,562, Roselle et al, issued Dec. 22, 1987 can also be added to the present compositions in appropriate amounts. Other common detergent ingredients consistent with the spirit and scope of the present invention are not excluded.

Since ADD compositions herein can contain water-sensitive ingredients or ingredients which can co-react when brought together in an aqueous environment, it is desirable to keep the free moisture content of the ADDs at a minimum, e.g., 7% or less, preferably 4% or less of the ADD; and to provide packaging which is substantially impermeable to water and carbon dioxide. Coating measures have been described herein to illustrate a way to protect the ingredients from each other and from air and moisture. Plastic bottles, including refillable or recyclable types, as well as conventional barrier cartons or boxes are another helpful means of assuring maximum shelf-storage stability. As noted, when ingredients are not highly compatible, it may further be desirable to coat at least one such ingredient with a low-foaming nonionic surfactant for protection. There are numerous waxy materials which can readily be used to form suitable coated particles of any such otherwise incompatible components; however, the formulator prefers those materials which do not have a marked tendency to deposit or form films on dishes including those of plastic construction.

Some preferred substantially chlorine bleach-free granular automatic dishwashing compositions of the invention are as follows: a substantially chlorine-bleach free automatic dishwashing composition comprising amylase (e.g., TERMAMYL®) and/or a bleach stable amylase and a bleach system comprising a source of hydrogen peroxide selected from sodium perborate and sodium percarbonate and a cobalt catalyst as defined herein. There is also contemplated a substantially chlorine-bleach free automatic dishwashing composition comprising an oxidative stability-enhanced amylase and a bleach system comprising a source of hydrogen peroxide selected from sodium perborate and sodium percarbonate, a cobalt catalyst, and TAED or NOBS.

Method for Cleaning:

The present invention also encompasses a method for cleaning soiled tableware comprising contacting said tableware with an aqueous medium comprising a cobalt catalyst, preferably at a concentration of from about 2 ppm to about 10 ppm, as described herein before. Preferred aqueous medium have an initial pH in a wash solution of above about 8, more preferably from about 9.5 to about 12, most preferably from about 9.5 to about 10.5.

This invention also encompasses a method of washing tableware in a domestic automatic dishwashing appliance, comprising treating the soiled tableware in an automatic dishwasher with an aqueous alkaline bath comprising the ADW composition of the present invention.

The following nonlimiting examples further illustrate ADD compositions of the present invention.

EXAMPLE 1

Preparation of $C_{9/11}EO_8BO_3$ Nonionic Surfactant

Neodol 91-8 (30.00 g, 58.7 mmol) is placed into a 250 ml three-necked round-bottomed flask, fitted with a heating mantle, magnetic stirrer, pressure equalizing dropping funnel, reflux condenser, internal thermometer and argon inlet, and dried under vacuum at 75° C. After releasing the vacuum with argon, sodium metal (0.03 g, 1.2 mmol) is placed into the flask and the mixture heated and stirred at 140° C. until all sodium is consumed. 1,2-Epoxybutane (12.71 g, 176.2 mmol) is then added dropwise at rate so as to keep the reaction temperature at >120° C., with a target of 140° C. After all of the 1,2-epoxybutane is added and refluxing has ceased, the mixture is stirred and heated an additional 3 h at 140° C. The 140° C. mixture is then placed under vacuum for 15 min to remove any traces of 1,2-epoxybutane. A light brown liquid is isolated. NMR is consistent with the desired compound.

EXAMPLE 2

Preparation of $C_{9/11}EO_8C(CH_3)_2CH_2CH_3$ Nonionic Surfactant

Neodol 91-8 (30.00 g, 58.7 mmol) is placed into a 250 ml three-necked round-bottomed flask, fitted with a heating mantle, magnetic stirrer, internal thermometer and argon inlet, and dried under vacuum at 75° C. After cooling to ambient and releasing the vacuum with argon, methylene chloride (12 ml) and 2-methyl-1-butene (4.53 g, 64.6 mmol) are added. Then boron trifluoride diethyl etherate (0.83 g, 5.9 mmol) is added all at once. This mixture is stirred 5 days at ambient. After adding 200 ml diethyl ether, the mixture is washed once with saturated sodium bicarbonate and once with brine. The ether layer is dried under magnesium sulfate and concentrated by rotary evaporation to leave a yellow liquid. NMR is consistent with the desired compound.

EXAMPLE 3

Preparation of $C_{9/11}EO_8(CH_2)_4CH_3$ Nonionic Surfactant

Anhydrous tetrahydrofaran (250 ml) and 60% sodium hydride (8.22 g, 205.6 mmol) are placed into a 500 ml three-necked round-bottomed flask, fitted with a magnetic stirrer, pressure equalizing dropping funnel, internal thermometer and argon inlet. After cooling the mixture to 0° C., Neodol 91-8 (35.00 g, 68.5 mmol) is added dropwise over 10 minutes. After warming to ambient, the mixture is stirred for 2 h. 1-Iodopentane (33.93 g, 171.3 mmol) is added dropwise over 10 minutes. After stirring at ambient for 4 days, the mixture is quenched with alcohol, neutralized with concentrated HCl, diluted with 500 ml diethyl ether, and then extracted once with saturated $NaHCO_3$ and once with brine. The ether layer is dried under magnesium sulfate and concentrated by rotary evaporation. This mixture is purified by flash chromatography (5:95 $MeOH:CH_2Cl_2$) to yield a gold liquid. NMR is consistent with the desired compound.

The following nonlimiting examples further illustrate compositions suitable for use in methods of the present invention.

EXAMPLE 4

Automatic dishwashing compositions:

| | Weight % | |
|---|---|---|
| Ingredients: | A | B |
| Sodium Tripolyphosphate (STPP) | 24.0 | 45.0 |
| Sodium Carbonate | 20.0 | 13.5 |
| Hydrated 2.0r Silicate | 15.0 | 13.5 |
| Nonionic Surfactant[1] | 3.0 | 3.0 |
| Poly-Tergent ® SLF 18B Nonionic surfactant[4] | 1.0 | 1.0 |
| Polymer[2] | 4.0 | — |
| Protease (4% active) | 0.83 | 0.83 |
| Amylase (0.8% active) | 0.5 | 0.5 |
| Perborate Monohydrate (15.5% active AvO)[3] | 14.5 | 14.5 |
| Cobalt Catalyst[4] | 0.008 | — |
| Dibenzoyl Peroxide (18% active) | 4.4 | 4.4 |
| Water, Sodium Sulfate, Misc. | Balance | Balance |

[1]Nonionic surfactant according to Example 1.
[2]Terpolymer selected from either 60% acrylic acid/20% maleic acie/20% ethyl acrylate, or 70% acrylic acid/10% maleic acid/20% ethyl acrylate.
[3]The AvO level of the above formula is 2.2%.
[4]Pentaamineacetatocobalt(III) nitrate prepared as described hereinbefore; may be replaced by MnTacN.
[5]Epoxy-capped poly(oxyalkylated) alcohol of Example III of WO 94/22800 wherein 1,2-epoxydodecane is substituted for 1,2-epoxydecane.

The following examples further illustrate phosphate built ADD compositions which contain a bleach/enzyme particle, but are not intended to be limiting thereof. These compositions are suitable for use in the methods of the present invention. All percentages noted are by weight of the finished compositions, other than the perborate (monohydrate) component, which is listed as AvO.

EXAMPLES 5–6

| Ingredients: | Weight % 5 | 6 |
|---|---|---|
| STPP | 30.0 | 32.0 |
| $Na_2CO_3$ | 30.5 | 20.5 |
| 2 R Silicate ($SiO_2$) | 8.0 | 4.0 |
| Catalyst[1] | 0.008 | 0.004 |
| Savinase ™ 12T | — | 1.1 |
| Protease D | 0.9 | — |
| Perborate (AvO) | 5.0 | 0.7 |
| Polymer[2] | 4.0 | — |
| Dibenzoyl Peroxide | 0.2 | 0.15 |
| Paraffin | 0.5 | 0.5 |
| Benzotriazole | 0.10 | 0.3 |
| Tergitol 15S9 Nonionic surfactant[5] | 0.5 | 0.5 |
| Nonionic Surfactant[3] | 2.0 | 2.0 |
| Sodium Sulfate, Moisture | Balance | |

[1]Pentaamineacetatocobalt(III) nitrate; may be replaced by MnTacN.
[2]Polyacrylate or Acusol 480N or polyacrylate/polymethacrylate copolymers.
[3]Nonionic surfactant according to Example 2.
[4]Ethoxylated secondary alcohol supplied by Union Carbide (cloud point = 60° C.).

In compositions of Examples 5 and 6, respectively, the catalyst and enzymes are introduced into the compositions as 200–2400 micron composite particles which are prepared by spray coating, fluidized bed granulation, marumarizing, prilling, or flaking/grinding operations. If desired, the protease and amylase enzymes may be separately formed into their respective catalyst/enzyme composite particles, for reasons of stability, and these separate compositions added to the compositions.

The following example further illustrate ADD granular compositions with chlorine bleach suitable for use in the methods of this present invention.

EXAMPLES 7–8

| Ingredients: | Weight % 7 | 8 |
|---|---|---|
| STPP | 25 | 31 |
| $Na_2CO_3$ | 23.0 | 15.0 |
| 2 R Silicate ($SiO_2$) | 17.5 | 25.0 |
| Hypochlorite | 1.0 | 3.0 |
| Polymer[1] | 2.0 | — |
| Dibenzoyl Peroxide | — | 0.15 |
| Paraffin | 1.0 | 1.0 |
| Nonionic Surfactant[2] | 2.0 | 3.0 |
| Sodium Sulfate, Moisture | Balance | |

[1]Polyacrylate or Acusol 480N or polyacrylate/polymethacrylate copolymers
[3]Nonionic surfactant according to Example 3.

The following examples further illustrate ADD liquid-gel compositions suitable for use in the methods of this present invention.

EXAMPLES 9–10

| Ingredients: | Weight % 9 | 10 |
|---|---|---|
| STPP | 32.0 | 25.0 |
| $Na_2CO_3$ | 0.7 | 2.0 |
| 2 R Silicate ($SiO_2$) | 0.3 | 1.0 |
| Savinase ™ 12T | 2.0 | 1.0 |
| Termamyl ™ | 1.4 | 0.5 |
| Perborate (AvO) | 3.5 | — |
| SLF 18 Nonionic surfactant[4] | 0.8 | 0.8 |
| Nonionic Surfactant[1] | 3.5 | 3.5 |
| Sodium Sulfate, Moisture | Balance | |

[1]Nonionic surfactant according to Example 3.
[2]Supplied by Olin Corporation (cloud point = 18° C.).

The following examples further illustrate ADD rinse aid compositions suitable for use in the methods of this present invention.

EXAMPLES 11–12

| Ingredients: | Weight % 11 | 12 |
|---|---|---|
| Citric Acid | 10.0 | 15.0 |
| Ethanol | 5.0 | 10.0 |
| HEDP Acid[1] | 1.0 | 0.7 |
| Sodium Cumene Sulfonate | 15.0 | 10.0 |
| Polymer[2] | — | 1.0 |
| Nonionic Surfactant[3] | 15.0 | 8.0 |
| Moisture | Balance | |

[1]1-Hydroxyethylidene-1,1-diphoshonic acid
[2]Polyacrylate or Acusol 480N or polyacrylate/polymethacrylate copolymers
[3]Nonionic surfactant according to Example 2.

The following examples further illustrate ADD tablet compositions suitable for use in the methods of this present invention.

EXAMPLES 13–14

| Ingredients: | Weight % 13 | 14 |
|---|---|---|
| STPP | 48.0 | 30 |
| $Na_2CO_3$ | 15.0 | 25.0 |
| 2 R Silicate ($SiO_2$) | 4.0 | 8.0 |
| Catalyst[1] | 0.008 | 0.004 |
| Savinase ™ 12T | — | 1.0 |
| Termamyl ™ | 0.6 | 0.5 |
| Perborate (AvO) | 10.0 | 15.0 |
| Polymer[2] | 2.0 | 2.0 |
| Dibenzoyl Peroxide | 0.2 | 0.15 |
| Paraffin | 1.0 | 1.0 |
| Benzotriazole | 0.5 | 0.5 |
| Tergitol 15S9 Nonionic surfactant | 1.0 | 1.0 |
| Nonionic Surfactant[3] | 3.0 | 3.0 |
| Sodium Sulfate, Moisture | Balance | |

[1]Pentaamineacetatocobalt(III) nitrate; may be replaced by MnTacN
[2]Polyacrylate or Acusol 480N or polyacrylate/polymethacrylate copolymers
[3]Nonionic surfactant according to Example 1.
[4]Ethoxylated secondary alcohol supplied by Union Carbide (cloud point = 60° C.).

What is claimed is:

1. An automatic dishwashing detergent composition comprising:

(a) from about 5% to about 90% by weight of the composition of a builder, (b) from about 0.1% to about 15% by weight of the composition of a nonionic surfactant, wherein said nonionic surface is selected from the group consisting of:

(i) a nonionic surfactant of the formula $$R^1(EO)_a(PO)_b(BO)_c$$

wherein R' is a linear or branched $C_6$ to $C_{20}$ alkyl; a is from about 2 to about 30; b is from 0 to about 30; c is from about 1 to about 30; and said nonionic surfactant has an X/Y number less than 1.90;

(ii) a nonionic surfactant of the formula:

$$R^1O[CH_2CH(R^3)O]_eR^2$$

wherein $R^1$ is a linear or branched, saturated or unsaturated, aliphatic or aromatic hydrocarbon on radicals having from 1 to 30 carbon atoms; $R^2$ is a linear or branched, saturated, aliphatic hydrocarbon radicals having from 1 to 30 carbon atoms, $R^3$ is H, or a linear aliphatic hydrocarbon radical having from 1 to 4 carbon atoms; e is an integer having an average value from 1 to 40, and (iii) mixtures thereof;

(c) from about 0.1% to about 40% by weight of the composition of a bleaching agent selected from the group consisting of hydrogen peroxide, a source of hydrogen peroxide, sodium perborate, sodium percarbonate, and mixtures thereof; and (d) adjunct materials.

2. The automatic dishwashing detergent composition according to claim 1 wherein said builder is a phosphate builder.

3. The automatic dishwashing detergent composition according to claim 1 further comprising a co-surfactant selected from the group consisting of low cloud point nonionic surfactants, high cloud point nonionic surfactants, anionic surfactants, and mixtures thereof.

4. The automatic dishwashing detergent composition according to claim 3 wherein the high cloud point nonionic surfactants are selected from the group consisting of straight chain fatty alcohols containing from about 6 to about 20 carbon atoms, branched chain fatty alcohols containing from about 6 to about 20 carbon atoms, secondary fatty alcohols containing from about 6 to about 20 carbon atoms, branched alcohol ethoxylates condensed with an average of from about 6 to about 15 moles of ethylene oxide per mole of alcohol, secondary alcohol ethoxylates condensed with an average of from about 6 to about 15 moles of ethylene oxide per mole of alcohol, and mixtures thereof.

5. The automatic dishwashing detergent composition according to claim 3 wherein the low cloud point nonionic surfactants are selected from the group consisting of ethoxylates derived from primary alcohol, polyoxypropylene/polyoxyethylene/polyoxypropylene reverse block polymers, ethoxylated-propoxylated alcohol, epoxy-capped poly (oxyalkylated) alcohols, and mixtures thereof.

6. The automatic dishwashing detergent composition according to claim 5 wherein the low cloud point nonionic surfactants have a cloud point of less than 20° C.

7. The automatic dishwashing detergent composition according to claim 6 wherein the low cloud point nonionic surfactants have a cloud point of less than 10° C.

8. The automatic dishwashing detergent composition according to claim 4, wherein the high cloud point nonionic surfactants have a cloud point of greater than 50° C.

9. The automatic dishwashing detergent composition according to claim 8 wherein the high cloud point nonionic surfactants have a cloud point of or greater than 60° C.

10. The composition according to claim 1 wherein said nonionic surfactant is selected from the group consisting of C9,11PO3EO13PO15; C9,11PO3EO13BO6; C9,11PO3EO13BO3; C9,11EO13BO6; C9,11EO13BO3; C9,11BO1EO13BO3; C9,11EO8BO3; C12,15EO7BO2; C9,11EO8BO2; C9,11EO8BO1; C12,13EO6.5TBO1; C9,11EO8C(CH3)2CH2CH3; C11/15EO15PO6C12/14; C9,11EO8($CH_2$)4CH3; and mixtures thereof.

11. The automatic dishwashing detergent composition according to claim 1 comprising a bleaching agent selected from hydrogen peroxide, a source of hydrogen peroxide, and mixture thereof.

12. The automatic dishwashing detergent composition according to claim 1 wherein said bleaching agent is dibenzoyl peroxide.

13. The automatic dishwashing detergent composition according to claim 1 comprising a bleaching agent selected from sodium perborate, sodium percarbonate, and mixtures thereof.

14. The automatic dishwashing detergent composition according to claim 1 wherein said bleaching agent further comprises dichloroisocyanurate.

15. The automatic dishwashing detergent composition according to claim 1 comprising a bleach activator material selected from the group consisting of tetraacetylethylenediamine, cationic bleach activators, and mixtures thereof.

16. The automatic dishwashing detergent composition according to claim 1 further comprising a metal-containing bleach catalyst selected from manganese-containing bleach catalysts, cobalt-containing bleach catalysts and mixtures thereof.

17. The automatic dishwashing detergent composition according to claim 16 wherein the cobalt-containing bleach catalyst has the formula:

$$Co[(NH_3)_nM'_mB'_bT_tQ_qP_p]Y_y$$

wherein cobalt is in the +3 oxidation state; n is an integer from 0 to 5; M' represents a monodentate ligand; m is an integer from 0 to 5; B' represents a bidentate ligand; b is an integer from 0 to 2; T' represents a tridentate ligand: t is 0 or 1; Q is a tetradentate ligand; q is 0 or 1 ; P is a pentadentate ligand; p is 0 or 1; and n+m+2b+3t+4q+5p=6; Y is one or more appropriately selected counteranions present in a number y, where y is an integer from 1 to 3, to obtain a charge-balanced salt; and wherein further at least one of the coordination sites attached to the cobalt is labile under automatic dishwashing use conditions and the remaining coordination sites stabilize the cobalt under automatic dishwashing conditions such that the reduction potential for cobalt (III) to cobalt (II) under alkaline conditions is less than 0.4 volts versus a normal hydrogen electrode.

18. The automatic dishwashing detergent composition according to claim 17 wherein the bleach catalyst is selected from the group consisting of pentaamineacetatocobalt (III) nitrate.

19. The automatic dishwashing detergent composition according to claim 1 further comprising a detersive enzyme.

20. The automatic dishwashing detergent composition according to claim 19 comprising a detersive enzyme selected from the group consisting of proteases, lipases, cellulase, analyses, and mixtures thereof.

21. The automatic dishwashing detergent composition according to claim 1 comprising less than 0.1% of active suds suppressing agent.

22. The automatic dishwashing detergent composition according to claim 1 in the form of granules, tablets, or liquidgels.

23. A method of washing tableware in a domestic automatic dishwashing appliance, said method comprising treating the soiled tableware in an automatic dishwasher with an aqueous alkaline bath comprising an automatic dishwashing composition according to claim 1.

* * * * *